United States Patent [19]

Hummel et al.

[11] Patent Number: 4,524,823

[45] Date of Patent: Jun. 25, 1985

[54] HEAT EXCHANGER HAVING A HELICAL DISTRIBUTOR LOCATED WITHIN THE CONNECTING TANK

[75] Inventors: Karl-Ernst Hummel, Bietigheim-Bissingen; Bohumil Humpolik, Ludwigsburg; Hans-Joachim Ingelmann, Iggingen-Schoenhardt; Karl-Heinz Staffa, Stuttgart, all of Fed. Rep. of Germany

[73] Assignee: Süddeutsch Kühlerfabrik Julius Fr. Behr GmbH & Co. KG, Stuttgart, Fed. Rep. of Germany

[21] Appl. No.: 593,120

[22] Filed: Mar. 26, 1984

[30] Foreign Application Priority Data

Mar. 30, 1983 [DE] Fed. Rep. of Germany ..... 3311579

[51] Int. Cl.[3] ..... F28F 9/22

[52] U.S. Cl. ..... 165/174; 62/527

[58] Field of Search ..... 165/174; 62/511, 527

[56] References Cited

U.S. PATENT DOCUMENTS

| | | | |
|---|---|---|---|
| 2,707,868 | 5/1955 | Goodman | 165/174 X |
| 3,073,575 | 1/1963 | Schulenberg | 165/174 X |
| 3,516,483 | 6/1970 | Benteler et al. | 165/174 X |
| 3,636,982 | 1/1972 | Drake | 138/38 |
| 4,202,182 | 5/1980 | Kawashima et al. | 165/174 X |
| 4,287,945 | 9/1981 | Hessari | 165/174 X |

FOREIGN PATENT DOCUMENTS

| | | | |
|---|---|---|---|
| 788045 | 12/1957 | United Kingdom | 165/174 |

*Primary Examiner*—Sheldon J. Richter

*Attorney, Agent, or Firm*—Schwartz, Jeffery, Schwaab, Mack, Blumenthal & Evans

[57] ABSTRACT

Disclosed is a heat exchanger comprising a plurality of parallel tubes and a plurality of ribs transverse to the tubes, and at least one connecting tank into which the tubes open. To obtain with simple and cost effectively produced means a uniform distribution of the fluid flowing through the heat exchanger over the heat exchanger tubes, the connecting tank has a chamber with a circular cross section and in the connecting tank a distributor installation is arranged which comprises a helical profiled body having an approximately stellate cross section which sealingly abuts with its ribs against the wall of the chamber. The partitions form a plurality of helical channels with one open and one closed end. An orifice is provided in the area of each channel for the passage of the fluid from the connecting tank into the tubes of the heat exchanger.

20 Claims, 12 Drawing Figures

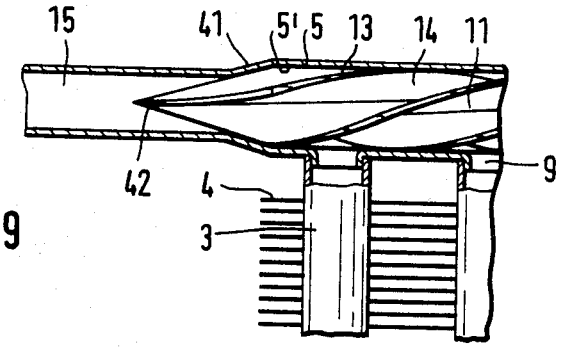
FIG. 9
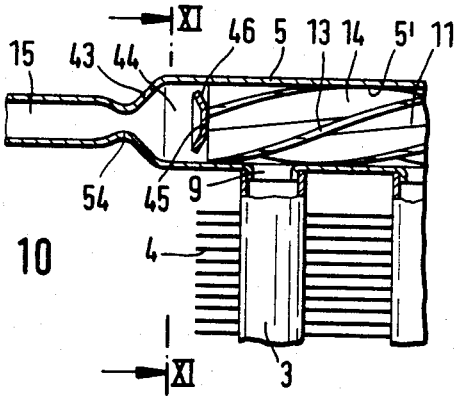
FIG. 10
FIG. 11
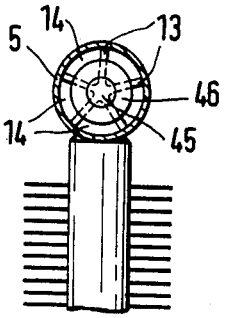
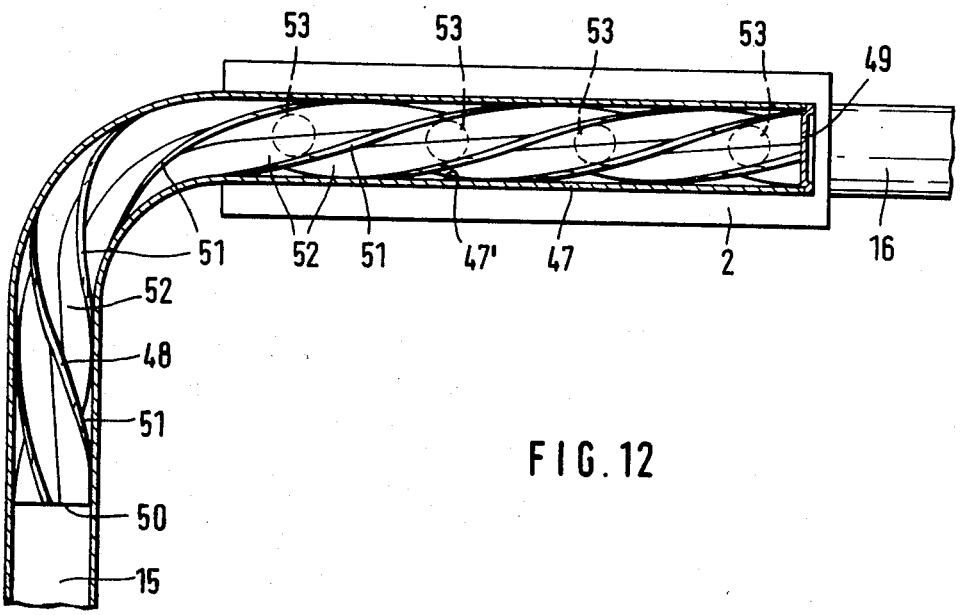
FIG. 12

HEAT EXCHANGER HAVING A HELICAL DISTRIBUTOR LOCATED WITHIN THE CONNECTING TANK

BACKGROUND OF THE INVENTION

The present invention relates to heat exchangers of the type consisting of a heat exchange block, comprising a plurality of parallel tubes and a plurality of ribs arranged transversely to said tubes, and at least one connecting tank with which said tubes are in communication.

Published French Application No. 2,036,696 describes a heat exchanger with an upper and lower water tank, in which the ends of the tubes open into a heat exchanger block consisting of tubes and ribs. The upper water tank has an inlet on one side and the lower water tank has an outlet for the heat exchanger fluid. In an arrangement of this type the individual tubes of the heat exchanger are utilized differently, i.e., the volume of the heat exchange fluid flowing through the individual heat exchanger tubes is very different, with the difference being determined essentially by the positions of the inlet and the outlet, and the installed position of the heat exchanger itself. The nonuniform filling of parallel heat exchanger tubes or parallel strands of tubes is noticeable particularly in heat exchangers operated with a coolant, such as the evaporators of air conditioning installations, leading to a substantial reduction in the performance of the heat exchanger.

Published British Application No. 2,078,362 describes a heat exchanger in which each of the parallel coils which begin and end in a connecting tank, is provided with a separate inlet tube. This results in uniform filling of the tube coils, but is not a solution for mass production in large volumes in view of the production costs, as several tubes of different configurations and a plurality of tube connections are required.

SUMMARY OF THE INVENTION

It is therefore an object of the present invention to provide a heat exchanger wherein a uniform distribution of the fluid flowing through the heat exchanger tubes is achieved.

It is a further object of the present invention to provide a heat exchanger of the type described above which is simple and may be cost effectively produced.

Still another object of the present invention is to provide a heat exchanger distribution device which introduces only a minimal amount of flow resistance.

Yet another object of the present invention is to provide a heat exchanger unit capable of evenly distributing homogeneous wet vapor mixtures.

Still a further object of the present invention is to provide a heat exhanger of the type described above which can, for available space or other reasons, extend uniformly around a bend.

In accomplishing the foregoing objects, there has been provided in accordance with the present invention a heat exchanger which comprises at least one connecting tank comprising a chamber of generally circular section; a plurality of parallel tubes, each in communication with the connecting tank; a plurality of ribs arranged transversely to the parallel tubes; and a distributor installation located within the connecting tank, comprising a plurality of helical chanels wherein each channel is in communication with at least one tube. Preferably, the distributor installation comprises a plurality of helical partitions positioned with equal angles between each successive pair and which extend radially outwardly from their origin at a central logitudinal axis. The distal edge of each partition sealingly abuts with the interior surface of the tank, resulting in a plurality of channels which extend the length of the connecting tank. One end of the distributor has been rotated about its longitudinal axis with respect to the other end thereby providing the distributor channels with a uniform helical configuration throughout.

In accordance with one preferred embodiment of the present invention, a second connecting tank is provided which communicates with each of the parallel tubes, and a collector installation is arranged within the second connecting tank, wherein the collector installation comprises a device having the same helical configuration as the distributor installation. In accordance with another embodiment of the present invention, a single common installation located within the connecting tank comprises an equal number of helical collector and distributor channels, wherein each channel is in communication with at least one tube.

The heat exchanger may be provided with a flow distributor arranged on the inlet end of the distributor installation, comprising a number of outlet channels corresponding to the number of channels in the distributor installation. The distributor installation may also comprise a conical configuration on its end facing the inlet in order to reduce flow resistance. In this case, the connecting tank comprises a conical taper wherein the angle of the taper corresponds to the angle of the cone, and the part of the cone circumference adjacent to the base of the cone is covered by the conical taper. Alternatively the heat exchanger may comprise a baffle plate arranged at the inlet end of the distributor installation, with a vortex chamber arranged in front thereof. Part of the connecting tank may be angled off in a bend, in which case the distributor installation extends uniformly in both the connecting tank and the bent part.

Further objects, features and advantages of the present invention will become apparent from the detailed description of preferred embodiments which follows, when considered together with the attached figures of drawing.

BRIEF DESCRIPTION OF THE DRAWINGS

In the drawings:

FIG. 9 is a partial cross-sectional view of a variant of the configuration of FIG. 2, with a tip molded onto the distributor device;

FIG. 10 is a partial cross-sectional view of a variant of the embodiment of FIG. 2, with a baffle plate and vortex cell in front of the distributor device;

FIG. 11 is a sectional on the line XI—XI in FIG. 10; and

FIG. 12 is a cross-sectional view of a distributor device located in a curved connecting tank.

DETAILED DESCRIPTION OF PREFERRED EMBODIMENTS

Figure 1:
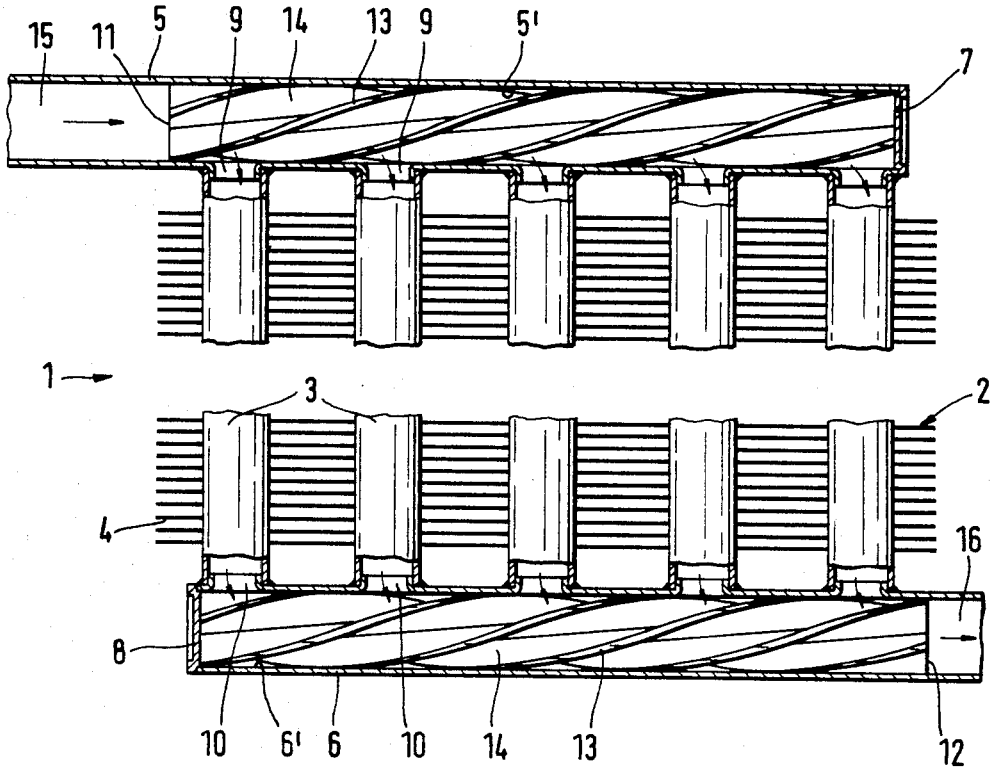
FIG. 1 is a plan view, partly in section, of a heat exchanger with an upper and a lower connecting tank and distributor and collector devices arranged therein according to the invention.

The essential advantages of the present invention are that the distribution means consists of a body with a simple configuration, which is easily manufactured. Thus, the distribution device may consist for example of an injection molded synthetic plastic body or a commercially available, semifinished metal shape, given the helical pitch desired of the helix by being twisted around the longitudinal axis. This results in a distribution device wherein no extreme changes in the direction of the fluid and thus no appreciable pressure losses occur.

Similarly to the distribution device in a first connecting tank, a helical profiled body of the same configuration may be provided as a collector installation in a second connecting tank. One preferred embodiment of the present invention consists of the arrangement in the connecting tank of a distributor and collector installation formed of a common profiled body such that an identical number of distributing channels and collecting channels is present between the partitions. Merely by the use of a greater number of ribs forming the partitions, an assembly can serve simultaneously as the distributor and the collector installation.

This arrangement is particularly suitable for heat exchangers built of U-shaped tubes. In the case of a common distribution and collector installation, a plate is arranged on opposite frontal sides of the installation, whereby on the inlet side the collector channels are closed off and on the outlet side the distributor channels are closed off.

The distribution installation according to the invention can, without any additional alteration, be provided with a flow distributor, such as those used for evaporators in air conditioning installations.

Differences in pressure drop, occurring as the result of different distances from the inlet of the heat exchanger tubes, may be compensated for in a simple manner by providing openings in the connecting tank of different sizes. The opening closest to the inlet has the smallest and the opening farthest from the inlet the largest cross-sectional diameter.

If the connecting tank consists of a synthetic resin material, connecting fittings may be provided to connect the heat exchanger tubes in a simple fashion.

To reduce the flow resistance presented by the cross-sectional area of the distributor installation, it is proposed to provide a conical extension of the distributor installation on the side facing the inlet. It is appropriate here to provide the connecting tank with a conical taper passing into the inlet, wherein the opening angle of the taper corresponds to the angle of the cone, and the part of the conical surface adjacent to the base area of the cone is covered by the conical taper. The cone of the connecting tank on the one hand immobilizes the distributor installation and on the other, it increases the passage cross section with respect to the inlet.

In other applications, for example in refrigerant evaporators, it is appropriate in order to obtain a wet vapor mixture as homogeneous as possible to arrange a baffle plate with a vortex chamber preceding it, on the side of the distributor installation adjacent to the inlet. The baffle plate has an edge pointing into the vortex chamber. In order to improve the effect of the baffle jet flow, a nozzle is provided in the inlet in front of the vortex chamber preventing the passage of a part of the flow without swirling past the baffle plate. The nozzle and the baffle plate preferably consist of a cavitation resistant material.

If for reasons of available space the inlet cannot extend in the same direction as the connecting tank and since for flow mechanical reasons the distributor installation should not begin in or immediately following a bend, it is readily possible that the distributor installation extends into the inlet uniformly in the connecting tank and the bend.

The pressure drop in the distributor system may be affected by the ratio of the opening and tube cross sections, which is important in particular in refrigerant evaporators. For this reason, the openings may have the configuration of a throttle.

The fastening of the distributor and collector installations, respectively, in the connecting tank and, in particular, security against rotation are attained in a simple manner by pressing the connecting tank, by means of a radially inward deformation, onto the partitions of the distributor and collector installations, respectively.

FIG. 1 shows a heat exchanger 1 serving as a heater in an automotive vehicle and comprising essentially the heat exchanger block consisting of the tubes 3 and the ribs 4 extending transversely to said tubes, together with an upper connecting tank 5 and a lower connecting tank 6. The upper connecting tank 5 and the lower connecting tank 6 are tubular and therefore have chambers 5′ and 6′ with circular cross sections, and each is closed off on one end by means of a plate 7 and 8. The upper connecting tank has five orifices 9, each opening into one of the tubes 3. The lower connecting tank 6 similarly has five orifices 10, to which the lower ends of the tubes 3 are joined. The tubes 3 are soldered to the connecting tanks 5 and 6.

In the upper connecting tank 5, a distributor installation 11 is located, consisting of a profile body with a stellate, i.e., star-like, cross section and a helical configuration. The star profile corresponds to the number of the tubes 3 connected with the connecting tank 5. In the present case, therefore, the star has five points. Both the connecting tanks 5 and 6 and the distributor and collector installation consist in the present embodiment of a metallic material.

The distributor installation 11 forms partitions 13 and channels 14 located between the partitions, which channels extend from the inlet 15 over the entire length of the distributor installation 11. Each of the orifices 9 is located within the area of one of the channels 14, so that the total volume of the fluid flowing in the inlet 15 is distributed uniformly over the channels 14 and thus uniformly over the heat exchanger tubes 3. In the lower connecting tank a collector installation 12 is located, which is identical in its configuration with the distributor installation 11. The collector installation 12 thus has the same partitions 13 and the channels 14 between them, wherein always one of the orifices 10 is within the area of one of the channels 14. The partial streams flowing in the channels 14 are combined in the outlet 16.

Figure 2:
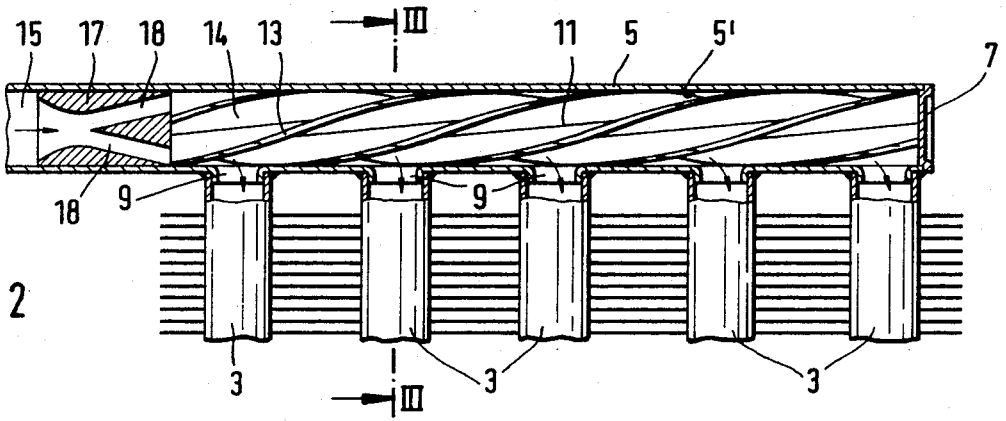
FIG. 2 is a similar view of a connecting tank for an evaporator with a venturi distributor arranged in front of the distributor installation.

FIG. 2 shows a connecting tank 5 for an evaporator, wherein the tubes of the evaporator are provided with the reference symbol 3, as in FIG. 1. The connecting tank 5 is tubular as in FIG. 1 and closed off at its end facing away from the inlet 15 with a plate 7. A distributor installation 11 is located within the connecting tank 5 which is in turn equipped with the orifices 9, corresponding to FIG. 1. On the end of the distributor installation 11 facing the inlet 15, a flow distributor 17, derived from a venturi nozzle, is located, said flow distributor having a number of outlet channels 18 corresponding to the number of channels 14 in the distributor installation 11, with said outlet channels opening into the channels 14. By means of the flow distributor 17 arranged in front of the distributor installation 17, the uniform distribution of the phases over each of the channels 14 is assured even in the case of nonhomogeneous flow media in the inlet 15.

Figure 3:
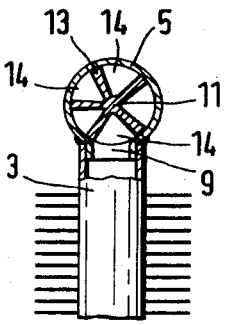
FIG. 3 is a section on the line III—III in FIG. 2.

FIG. 3 shows a section on the line III—III in FIG. 2. As seen in this view, a distributor installation 11 with a stellate cross section is located in the tubular connecting tank 5, wherein five partitions 13, uniformly distributed over the circumference, extend to the inner wall of the connecting tank 5 and abut sealingly against said inner wall. The channel 14 pointing vertically downward in FIG. 3 is located over the orifice 9 in the connecting tank 5, to which the heat exchanger tube 3 is fastened.

Figure 4:
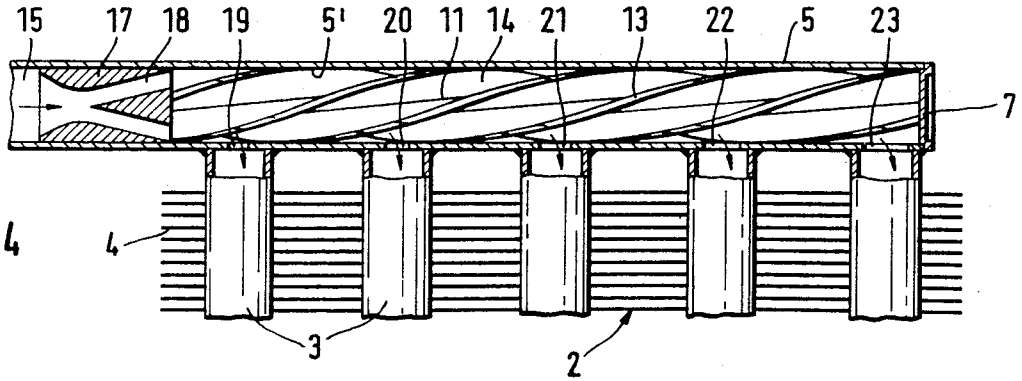
FIG. 4 shows a variant of the embodiment of FIG. 3.

In FIG. 4 a variant of the embodiment of the connecting tank 5 shown in FIG. 2 is displayed. Identical parts have reference numerals identical with those in FIGS. 1 and 2. The connecting tank 5 has five orifices 19–23 of different dimensions, with the orifice 19 located closet to the flow distributor 17 having the smallest and the orifice 23 located farthest from the from the flow distributor, the largest cross-sectional diameter. Differences in the pressure drop in the individual channels 14 resulting from the difference in the distance between the individual orifices 19–23 and the flow distributor 17 are thereby compensated for.

Figure 5:
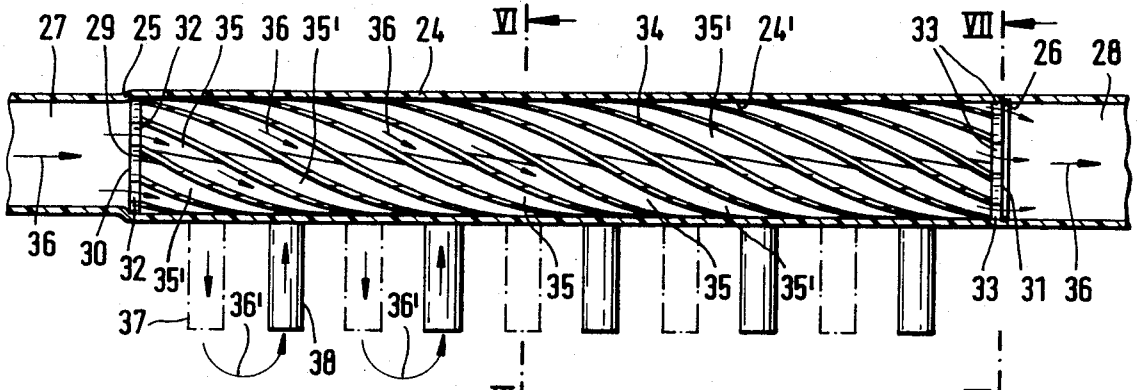
FIG. 5 is a similar view showing a connecting tank containing a common distributor and collector installation.

FIG. 5 shows a tubular connecting tank 24 consisting of a synthetic resin material and equipped on one side with a flow medium inlet 27 and on the other side with a flow medium outlet 28. The cross section of the flow medium inlet 27 is slightly smaller than the cross section of the chamber 24′ in the connecting tank 24, whereby a shoulder 25 is formed at the end of the inlet. A distributor and collector installation 29 rests against the shoulder 25, said installation having the configuration of a helix with a stellate cross section. The helical shape 29 is made, similarly to the connecting tank 24, of a synthetic resin material. The profiled body has ten partitions 34, arranged in a star pattern, with a channel 35 and 35′ being formed between each two partitions 34.

The collector and distributor installation has at its end facing the inlet 27 an end plate 30, which covers every other channel 35′ and through corresponding orifices 32 permits the passage of the flow medium into the remaining channels 35. On the end facing the outlet 28 there is again an end plate 31 covering the channels 35 which are connected by means of the orifices 32 with the inlet 27. The end plate 31 is equipped with the orifices 33 so that the channels 35′, which are covered by the end plate 30, are connected with the outlet 28. The distributor and collector installation 29 is secured in its position on the one hand by the shoulder 25 and on the other hand by a retaining ring 26. The arrows 36 indicate the flow path of the fluid. The arrows designated 36′ indicate the flow through the heat exchanger tubes. The symbols 37 and 38 designate tube connection fittings extending into the ends, not shown in FIG. 5, of the heat exchanger tubes 3.

Figure 6:
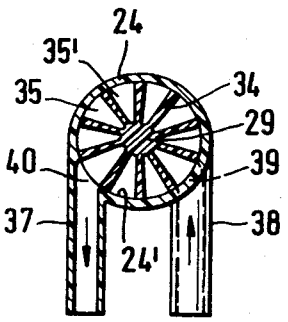
FIG. 6 is a section on the line VI—VI in FIG. 5.

FIG. 6 shows the section on the line VI—VI in FIG. 5. It is apparent in the sectional view that the collector and distributor installation 29 consists of a stellate profiled body comprising ten partitions 34 with channels 35, 35′ formed between them. The connecting fittings 37 is in communication with one of the channels 35 and the connecting fitting 38 with one of the channels 35′. The outer end of the partition 34 abuts against the inner wall of the tubular connecting tank 24 and may be secured additionally, if necessary in certain applications, for example, by means of an adhesive.

Figure 7:
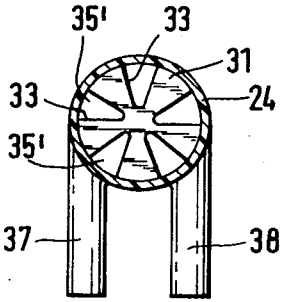
FIG. 7 is a section of the line VII—VII in FIG. 5.

FIG. 7 shows the section on the line VII—VII in FIG. 5. It is seen in this view that the end plate 31 covers every second channel of the stellate profiled body of the distributor and collector installation and that the channels 35′ are open on this side through the corresponding orifices 33.

Figure 8:
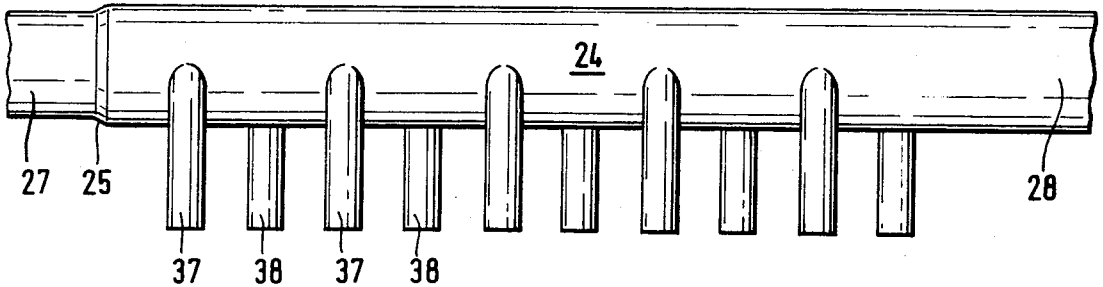
FIG. 8 is an external view of the connecting tank according to FIG. 5 with molded tube fittings.

FIG. 8 shows from outside the connecting tank 24 having molded connecting fittings 37 and 38. On the side to the left of the connecting tank 24, the latter has a shoulder 25 at the transition to the inlet 27. On the side to the right in the drawing of the connecting tank 24 there is the outlet 28. Corresponding to the number of the channels shown in FIG. 5 and 6 of the collector and distributor installation, the connecting tank has five tube connection fittings 37 in communication with the distributor channels 35, and five tube connection fittings 38 communicating with the collector channels 35′. The tubes of the heat exchanger block may be fastened to the tube connection fittings 37 and 38 for example by joining elements, such as those described in DE-OS No. 31 26 030.

In FIG. 9, part of a connecting tank 5 is shown together with a distributor installation arranged therein, with the distributor installation comprising the partitions 13, the channels 14 and the orifices 9 being present in the connecting tank 5 to connect the heat exchanger tubes 3 with the channel 14. On the end of the connecting tank 5 facing the inlet 15, the former has a conical taper passing over into the inlet 15. On the end facing the inlet 15, the distributor installation 11 has a molded cone 42, wherein the cone angle corresponds to the conical taper 41, and the cone 42 rests against said taper. By means of the conical configuration of the end on the inlet side of the distributor installation 11, the flow resistance offered by the distributor body 11 without the cone 42 is significantly reduced.

FIG. 10 shows a part of a connecting tank 5, wherein the distributor installation 11 and the orifices 9, the tubes 3 and the ribs 4 correspond to the configuration according to FIG. 1. An approximately bell shaped transition to an inlet 15 with a substantially smaller cross section is molded onto the connecting tank 5 on its end adjacent to the inlet 15. To the frontal end of the distributor installation 11 located adjacent to the inlet 15, a baffle plate 45 is attached, said baffle plate having an edge directed at the bell shaped transition 43 and being at an adequate distance from the inner circumference of the connecting tank to permit the passage of the fluid. Between the baffle plate 45 and the bell shaped transition 43, a vortex chamber 44 is formed. Adjacent to the bell shaped transition 43, a nozzle 54 is provided in the inlet 15, formed by an appropriate deformation of the inlet tube. Such a measure is suitable, for example, for evaporators, to produce in the vortex chamber prior to the division of the partial streams a wet vapor mixture that is as homogeneous as possible. The more homogeneous the mixture and the more uniform its distribution over the individual tubes, the more efficient the evaporator will be.

FIG. 11 shows a section on the line XI—XI in FIG. 10. It is apparent from this view that, between the edge 46 of the baffle plate 45 and the inner wall of the connecting tank 5, an adequate distance is present for the passage of the fluid into the distributor channels 14.

In FIG. 12 a connecting tank 47 arranged on a heat exchanger block 2 is shown, the tank 47 having a part 48 angled in a bend of 90° and passing over into the inlet 15. The end of the connecting tank 47, comprising a void 47' with a circular cross section, is closed off by a plate 49. In the connecting tank 47 and the bent part 48 is located a distributor installation 50, consisting of a stellate profiled body. Corresponding to the number or orifices 53 in the connecting tank 47 to which the tubes of the heat exchanger block 2 are joined, the distributor installation 50 has the cross-sectional configuration of a four point star. The helical distributor installation thus comprises 4 helical partitions 51 and channels 52 between them.

The distributor installation 50 is inserted into the connecting tank prior to the bending of the part 48 of the connecting tank 47, i.e., in a straight shape, and the part 48 is subsequently bent, together with the distributor installation 50 located therein. The partitions 51 are deformed uniformly in the area of the arc, obviously with compression on the internal radius and elongation on the outer radius, but there is no appreciable change in the cross section of the channels 52.

As described in the exemplary embodiment above, the connecting tanks and the distributor and collector installations, respectively, may be made of a metal or a synthetic resin material. It is also possible to combine different materials, i.e., a metal with a plastic. Depending on the application, the requirements concerning the tightness of the individual channels may differ. Thus, if the invention is used in a radiator or heater of an automotive vehicle, a slight leakage is without effect on the operation of the distributor installation. Very efficient sealing may be obtained by press-fitting a synthetic resinous distributor and collector installation into a metal connecting tank. Finally, in certain cases additional sealing may be provided by means of an adhesive between the ends of the partitions and the inner wall of the connecting tank. To immobilize the distributor and collector installation, especially against rotation, it is particularly advantageous to fasten the distributor and collector installation in the connecting tank by means of a radially inward deformation of the connecting tank.

What is claimed is:

1. A heat exchanger, comprising:

at least one connecting tank comprising a chamber of substantially circular cross-section;

a plurality of essentially parallel tubes, each in communication with the connection tank;

a plurality of ribs arranged transversely to the parallel tubes; and a distributor installation located within the connecting tank, comprising a plurality of helical distributor channels wherein each channel is in communication with at least one of said tubes and comprises one open and one closed end.

2. A heat exchanger according to claim 1, further comprising a flow distributor mounted on the side adjacent to the inlet of the distributor installation, comprising a number of outlet channels corresponding to the number of channels of the distributor installation.

3. A heat exchanger according to claim 1, wherein the communicating orifices between the connecting tank and the tubes are of different sizes, and wherein the orifice located nearest to the inlet has the smallest and the orifice located farthest from the inlet has the largest cross section.

4. A heat exchanger according to claim 1, further comprising a plurality of connecting fittings injection molded onto the connecting tank to connect the heat exchanger tubes; and wherein the connecting tank is made of a synthetic resin material.

5. A heat exchanger according to claim 1, wherein the distributor installation comprises a conical configuration on its end facing the inlet.

6. A heat exchanger according to claim 5, wherein the inlet end of the connecting tank comprises a conical taper, the angle of the taper corresponding to the angle of the cone, and wherein the part of the cone circumference adjacent to the base area of the cone is covered by the conical taper.

7. A heat exchanger according to claim 1, further comprising a baffle plate arranged at the inlet end of the distributor installation and a vortex chamber arranged in front of said baffle plate.

8. A heat exchanger according to claim 7, wherein the baffle plate comprises an edge directed into the vortex chamber.

9. A heat exchanger according to claim 7, further comprising a nozzle arranged in the inlet in front of the vortex chamber.

10. A heat exchanger according to claim 9, wherein the baffle plate and the nozzle are made of a cavitation resistant material.

11. A heat exchanger according to claim 1, wherein part of the connecting tank is angled off in a bend and the distributor installation extends in both the connecting tank and the bent part.

12. A heat exchanger according to claim 1, wherein the outlet end of the connecting tank is closed off by means of a plate.

13. A heat exchanger according to claim 1, wherein the communication opening between the connecting tank and the tubes are in the form of throttles.

14. A heat exchanger according to claim 1, wherein the distributor comprises a plurality of helical partitions extending radially outward from a union at a common longidudinal axis, wherein the distal edge of each partition sealingly abuts with the interior surface of said chamber, resulting in a plurality of channels which run the length of the connecting tank, each channel being defined on two sides by adjacent partitions and on a third side by the interior surface of the connecting tank.

15. A heat exchanger according to claim 14, wherein the joints formed by the abutment of the partitions and the interior surface of said chamber are sealed with an adhesive.

16. A heat exchanger according to claim 1, further comprising:

a second connecting tank comprising a second chamber of substantially circular cross-section, said second tank being in communication with each of said tubes; and a collector installation arranged within the second chamber wherein the collector installation comprises a plurality of helical collector channels wherein each channel is in communication with at least one of said tubes and comprises one open end and one closed end.

17. A heat exchanger according to claim 1, wherein said distributor further comprises a collector portion comprising a plurality of helical collector channels wherein each collector channel is in communication with at least one of said tubes which is different from those tubes in communication with said distributor channels, and wherein each collector channel has one closed end and one open end.

18. A heat exchanger according to claim 17, wherein the closed ends of said collector channels are on the opposite end from the closed end of said distributor channels.

19. A heat exchanger according to claim 18, further comprising:

an inlet at one end of the distributor and collector;

an outlet at the other end of the distributor and collector; and an end plate attached to each end, wherein the end plate on the inlet end of the distributor and collector close off all of the collector channels, and the end plate on the outlet end of the distributor and collector closes off all of the distributor channels.

20. A heat exchanger according to claim 17, wherein the distributor and collector are fastened and secured against rotation in the connecting tank by means of a radially inward deformation of the connecting tank.

* * * * *